United States Patent [19]

Krautkremer et al.

[11] 4,419,082

[45] Dec. 6, 1983

[54] WATER-JET DRIVE MECHANISM FOR DRIVING AND CONTROLLING OF PARTICULARLY SHALLOW-DRAUGHT WATERCRAFTS

[75] Inventors: Franz Krautkremer; Siegfried Lais, both of Spay, Rhein, Fed. Rep. of Germany

[73] Assignee: Schottel-Werft Josef Becker GmbH & Co KG, Spay, Rhein, Fed. Rep. of Germany

[21] Appl. No.: 271,898

[22] Filed: Jun. 9, 1981

[30] Foreign Application Priority Data

Jun. 19, 1980 [DE] Fed. Rep. of Germany ..... 3022903

[51] Int. Cl.[3] ..... B63H 11/02

[52] U.S. Cl. ..... 440/42; 114/151; 440/47; 60/221

[58] Field of Search ..... 440/40–43, 440/45–47; 60/221, 222, 232; 416/20 R, 20 A; 114/151

[56] References Cited

U.S. PATENT DOCUMENTS 3,882,674 5/1975 Taggart ..... 60/221

4,278,431 7/1981 Krautkremer et al. ..... 440/42

FOREIGN PATENT DOCUMENTS 860152 7/1949 Fed. Rep. of Germany ..... 60/221

2757454 7/1979 Fed. Rep. of Germany ..... 440/42

2256866 8/1975 France ..... 440/43

*Primary Examiner*—Galen L. Barefoot

*Assistant Examiner*—Stephen P. Avila

*Attorney, Agent, or Firm*—Flynn, Thiel, Boutell & Tanis

[57] ABSTRACT

A water-jet drive mechanism for driving and controlling a watercraft includes a substantially cylindrical support housing which is supported for rotational movement about a substantially vertical pivot axis in a cylindrical recess in the undersurface of the watercraft, with its undersurface flush with that of the watercraft. A centrifugal water pump is encased in the support housing so that its inlet and its discharge nozzle open through the undersurface of the support housing. The pump drive shaft is inclined and lies in a vertical plane arranged at an angle to the direction of water discharge from the nozzle. A normally open ventilating valve provided in a wall of the pump is closed by the flow of water through the pump.

4 Claims, 4 Drawing Figures

WATER-JET DRIVE MECHANISM FOR DRIVING AND CONTROLLING OF PARTICULARLY SHALLOW-DRAUGHT WATERCRAFTS

CROSS-REFERENCE TO RELATED APPLICATION

The subject matter of this application is related to that in a copending application Ser. No. 271,897 entitled WATER-JET DRIVE MECHANISM FOR DRIVING AND CONTROLLING OF PARTICULARLY SHALLOW-DRAUGHT WATERCRAFTS and filed concurrently herewith by Franz Krautkremer, Achim Kessler and Gerd Krautkraemer.

FIELD OF THE INVENTION

This invention relates to a water-jet drive mechanism for driving and controlling a watercraft, particularly a shallow-draught watercraft, which comprises a pump supported in a housing pivotal about a substantially vertical axis, which pump sucks in water at the bottom of the ship and ejects the water in a downwardly inclined direction, wherein the inlet and discharge openings do not project below the undersurface or the keel of the watercraft.

SUMMARY OF THE INVENTION

The basic purpose of the invention is to improve the output of the drive mechanism during cruising or marsh travel and also when starting it, while assuring it has minimal weight and requires minimal space.

To attain this purpose, a water-jet drive mechanism is provided which includes a centrifugal pump having an impeller which rotates in a spiral housing or the like.

The drive mechanism according to the invention has the advantage that it is protected against damage during ground contact and is suited for small and highly maneuverable vehicles. It takes up minimal space and has minimal weight. The drive has self-suction and is substantially insensitive to sand or other dirt which flows in. Also, good maneuverability exists, namely because of a continuously rotationally controllable thrust jet.

A further improvement in efficiency and a further reduction in the space needed results from the axis of rotation of the pump being inclined with respect to the swivel axis of its support housing so as to lie in a plane arranged at an angle to the water discharge direction at the nozzle of the spiral housing and the direction of travel of the watercraft. This improvement is based on the inclined pump axis lying in a plane which is not parallel to the direction of the nozzle discharge, which is usually parallel to the direction of travel, but at an angle thereto. From this, the following advantages result for a pump which runs in a spiral housing.

A deflection of the water from the plane of the spiral housing into the plane of the nozzle is not needed.

For the same thrust output, the inventive drive mechanism requires a smaller space than known drive mechanisms.

The device according to the invention has a smaller discharge angle, namely, the angle between the boat's undersurface and the direction of discharge of the water jet.

The inclined arrangement of the spiral housing effects a better feed of the water into the suction inlet opening, advantageously creates an obstruction surface transverse to the direction of travel, and produces a pressure increase at the inlet opening so that at the same output a higher thrust results.

The drive mechanism is protected against damage due to ground contact by an arrangement in which the pump is located within the body of the watercraft.

An improvement of the output of the drive mechanism results from a development of the invention wherein at least one ventilating valve is provided in the spiral housing which, depending on the pressure in the spiral housing, can connect the inside of the spiral housing to the outside air.

Particularly safe operation and minimal susceptibility to trouble is achieved by a development of the invention in which the ventilating valve includes a valve member or the like for a ventilating opening which is operated by the pressure of the water flowing in the pump. The arrangement can advantageously be one in which the weight of the valve member or a spring force keeps the ventilating opening open when the spiral housing is substantially empty, and the valve member is urged to and maintained in a position closing off the ventilating opening by the flow of liquid in the spiral housing.

A particularly simple and inexpensive embodiment of the invention results from the valve member being movably supported by a linkage so that it can fall into the area of the flowing liquid substantially as a result of its own weight. If the weight of the valve member is not sufficient in and of itself, an advantageous development results when a spring or the like is provided to urge the valve member to the closed position.

BRIEF DESCRIPTION OF THE DRAWINGS

Further advantages and characteristics of the invention can be taken from the following description in connection with FIGS. 1 to 4, in which.

DETAILED DESCRIPTION

Figure 1:
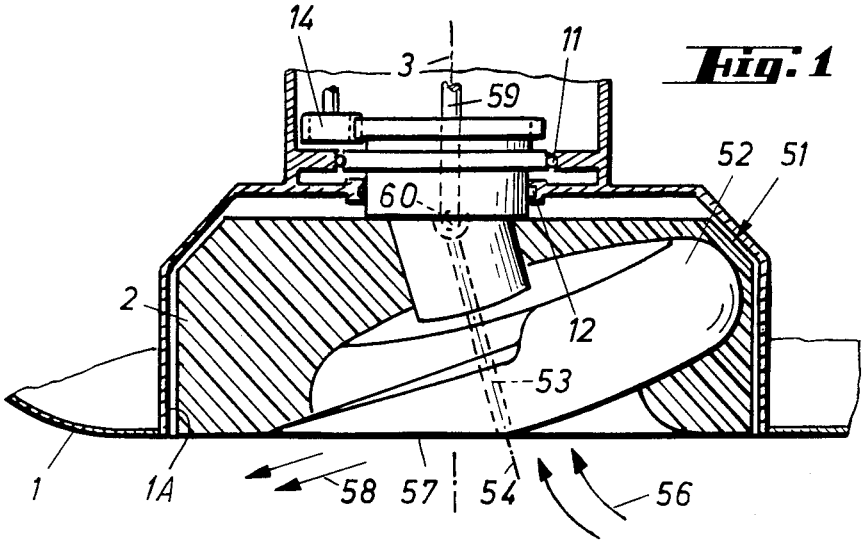
FIG. 1 is a cross-sectional side view of an exemplary embodiment of a water-jet drive mechanism embodying the invention.

A cylindrical support housing 2 is rotationally supported about a vertical swivel axis 3 in a cylindrical well or recess 1A in the undersurface of a shallow-draught watercraft 1. Only the outer circumference of the support housing 2 is illustrated in the schematic drawing of FIG. 2. A centrifugal pump 51 is encased in the support housing 2. The centrifugal pump 51 is conventional, and therefore only its spiral housing 52 is illustrated and the pump is not described in detail. The spiral housing 52 is supported in the support housing in such a manner that the pump drive shaft 53 and thus the axis of rotation 54 of the pump impeller are inclined with respect to the swivel axis 3 and also with respect to the direction of travel 55 of the watercraft 1. Thus, the centrifugal pump 51 sucks water into its central inlet opening, located at the bottom of the watercraft 1, as indicated by the arrows 56, and ejects the water through a discharge nozzle 57 in the direction of the arrows 58. Since the discharge from the nozzle 57 is directed substantially opposite the direction of travel 55, a thrust is exerted on the watercraft due to the ejected water. The axis of rotation 54 is also inclined with respect to the direction of discharge of the nozzle. This arrangement results in a small enclosed space and minimal flow resistance for the sucked-in water. The centrifugal pump 51 is arranged just above the undersurface of the ship. The inlet opening of the pump 51 can be covered by a grid which is not illustrated, in order to prevent the entrance of foreign matter. The pivotal housing 2 may consist totally or partially of foamable plastic. The rotational support of the pivotal housing 2 is indicated schematically with a bearing 11, and reference numeral 12 identifies a schematically illustrated seal. In practice, all conventional measures for proper support and sealing must be considered.

The pivotal housing 2 is rotationally driven by a not-illustrated control motor through a gear drive, worm gearing or any other suitable gearing 14. The centrifugal pump 51 is driven by a not-illustrated drive motor supported in the body of the watercraft 1 or on the pivotal housing 2. The drive motor transmits power through conventional elements such as a drive shaft 59 and a coupling 60 to the pump drive shaft 53. In an actual arrangement of the drive shaft, all conventional aspects must be considered. The pivotal housing 2 is designed and built into the watercraft 1 so that it adapts exactly to the recess 1A in the body of the watercraft 1 and ends substantially flush with the undersurface of the watercraft 1.

Figure 2:
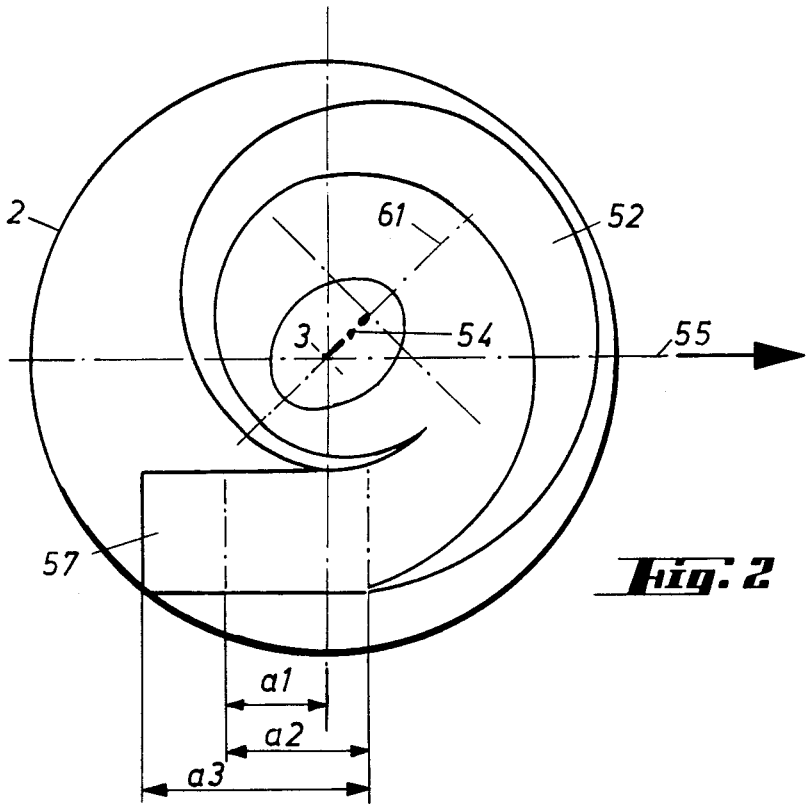
FIG. 2 is a top view schematically illustrating a spiral housing of FIG. 1 inclined according to the invention.

The advantageous arrangement of the nozzle 57 is made clear in FIG. 2. One effective length of the nozzle 57 is identified with reference character al, which length would result if the pump drive shaft axis 54 were vertical. Reference character a2 identifies the effective length of the nozzle for an arrangement of the spiral housing 52 in which the axis of rotation 54 of the pump impeller is inclined so as to lie in a vertical plane which is parallel to the outlet direction of the nozzle 57 and thus usually parallel to the direction of travel of the watercraft 1. Reference character a3 identifies the effective length of the nozzle 57 which results when the axis of rotation 54 is inclined according to the invention so as to lie in a vertical plane 61 (FIG. 2) arranged at an acute angle with respect to the outlet direction of the nozzle and the direction of travel of the watercraft 1. Corresponding increases also occur in the effective height of the nozzle (in the projection of FIG. 1). The advantages described hereinabove result through this arrangement of the nozzle 57 according to the invention.

Figure 3:
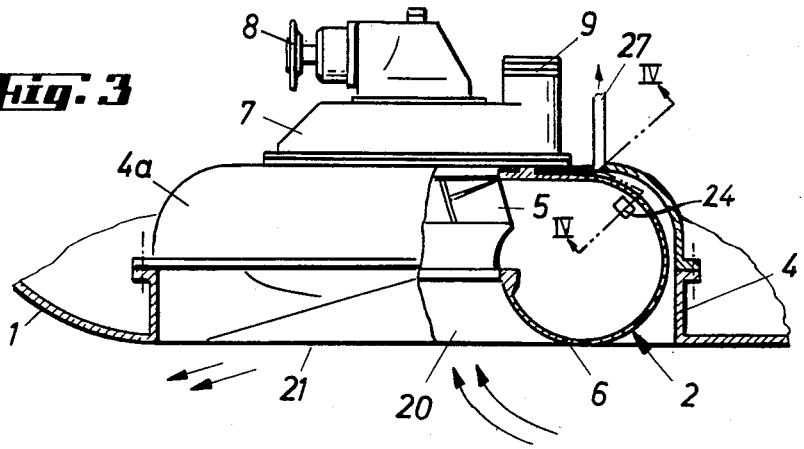
FIG. 3 is a cross-sectional side view illustrating an alternative embodiment of a water-jet drive mechanism according to the invention.
Figure 4:
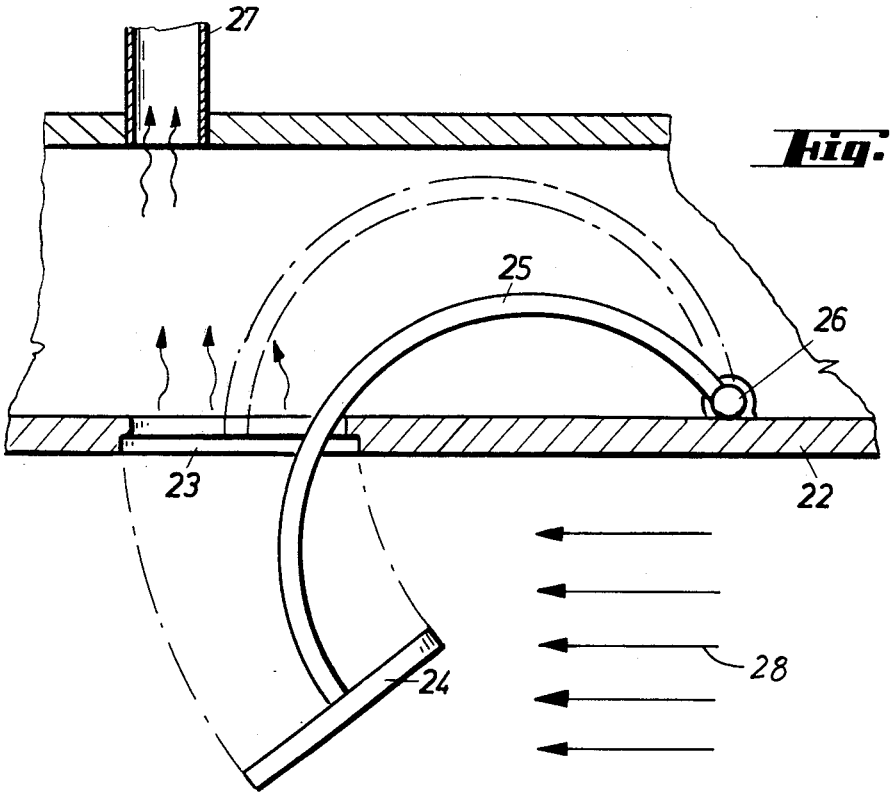
FIG. 4 is a sectional view taken along the line IV—IV of FIG. 3 which illustrates in an enlarged scale details of a ventilating valve according to the invention.

An alternative embodiment of the invention is illustrated in FIGS. 3 and 4. The centrifugal pump 2 is supported adjacent the undersurface of the body of the watercraft 1. To receive the centrifugal pump 2, a so-called well or recess 4 is provided in the hull and is closed off with a lid 4*a*. The centrifugal pump 2 includes an impeller 5 which is enclosed in a conventional manner by a spiral housing 6. The centrifugal pump 2 serves both to propel and also to control the ship. The spiral housing 6 is for this purpose supported for rotation about a vertical axis by and below a gearbox 7 which in turn is secured on the well lid 4*a*.

The impeller 5 of the centrifugal pump 2 is driven by a not-illustrated conventional motor through conventional and not-illustrated gear elements, a coupling 8 and a miter gear provided in the gearbox 7. A second motor 9 is provided to drive the rotational movement of the spiral housing 6 through conventional gear members which are also provided in the gearbox 7.

Water is sucked in through an inlet opening 20, is pressed into the spiral housing 6 by the impeller 5 and is ejected through a conventional nozzle 21. In this manner, the watercraft 1 or the like is driven. By rotating the spiral housing and thus by changing the discharge direction of the nozzle 21, the watercraft 1 can be controlled.

FIG. 4 illustrates a detail of FIG. 3 which is an exemplary embodiment of a ventilating valve according to the invention. A ventilating opening 23 is provided in a wall 22 of the spiral housing 6. A valve member 24 fits snugly into the ventilating opening 23 and is pivotally supported at a pivot joint 26 by means of a linkage element 25 or the like, so that it drops into the position which is shown in FIG. 4 due to its own weight. In the other extreme position, the valve member closes off the valve opening, as evident from the position of the linkage element illustrated in dashdotted lines. A ventilating pipe 27 is provided on the lid 4*a*.

Particularly when immersing the centrifugal pump into the water, as happens during installation and also for example when the watercraft is placed into the water, air is present in the spiral housing when the pump is started. During starting, the air is removed by the conveyed water and can escape through the ventilating opening 23 and the ventilating pipe 27. When the air has been forced out, the pressure of the water flowing in the direction indicated by flow lines 28 urges the valve member 24 into sealing engagement with the ventilating opening 23. Since the linkage 25 is outside of the spiral housing 6 and the valve member is flush with the inside surface of the spiral housing 6, the ventilating valve does not create a flow resistance during operation. The effect of the weight of the valve member can, if desired, be replaced by or assisted by a not-illustrated spring.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a water-jet drive mechanism for propelling and controlling a watercraft on a body of water, including a pump having an inlet opening communicating with said body of water and a nozzle extending in a downwardly inclined direction, said pump being supported in a support housing which is pivotal about a substantially vertical axis, and sucking water into said inlet opening and then ejecting it through said nozzle in said downwardly inclined direction, said inlet opening and nozzle being located above the undersurface of said watercraft, said pump being a centrifugal pump having an impeller which rotates in a spiral housing, the improvement comprising wherein the axis of rotation of said impeller of said pump is inclined with respect to said pivot axis of said support housing and lies in a vertical plane arranged at an angle with respect to said direction of said nozzle, whereby the effective length and height of said nozzle are larger than if said axis of rotation of said impeller of said pump were to lie in a vertical plane parallel to said direction of said nozzle.

2. The drive mechanism according to claim 1, wherein said centrifugal pump is located within a recess provided in the undersurface of said watercraft.

3. The drive mechanism according to claim 1, wherein said plane is arranged at an acute angle with respect to the said direction of said nozzle.

4. The drive mechanism according to claim 2, wherein said recess in said watercraft is generally cylindrical, wherein said support housing is generally cylindrical, has a diameter substantially equal to that of said recess, and is rotatably supported within said recess coaxial therewith, and wherein the undersurface of said support housing is substantially flush with the undersurface of said watercraft.

* * * * *